US011124998B1

(12) United States Patent
Fazi et al.

(10) Patent No.: US 11,124,998 B1
(45) Date of Patent: Sep. 21, 2021

(54) MOLDED FRAME FOR A REVERSIBLE APPLIANCE DOOR

(71) Applicant: Dometic Sweden AB, Solna (SE)

(72) Inventors: Mark Raymond Fazi, Osceola, IN (US); Adam J. Warble, Elkhart, IN (US); Mark L. Smith, Buchanan, MI (US)

(73) Assignee: Dometic Sweden AB, Solna (SE)

( * ) Notice: Subject to any disclaimer, the term of this patent is extended or adjusted under 35 U.S.C. 154(b) by 155 days.

(21) Appl. No.: 16/198,009

(22) Filed: Nov. 21, 2018

Related U.S. Application Data

(60) Provisional application No. 62/589,967, filed on Nov. 22, 2017.

(51) Int. Cl.
*E05D 7/02* (2006.01)
*F25D 23/02* (2006.01)
*E06B 3/70* (2006.01)

(52) U.S. Cl.
CPC ..... *E05D 7/02* (2013.01); *E06B 3/70* (2013.01); *F25D 23/028* (2013.01); *E05Y 2900/30* (2013.01); *E05Y 2900/31* (2013.01); *E06B 2003/7055* (2013.01)

(58) Field of Classification Search
CPC ..... E05Y 2900/31; E05Y 2900/30; F25D 23/028; F25D 23/02; E05D 7/02; E06B 3/70; E06B 2003/7055
See application file for complete search history.

(56) References Cited

U.S. PATENT DOCUMENTS

| | | | | |
|---|---|---|---|---|
| 1,749,336 A | | 3/1930 | Geyer | |
| 3,389,424 A | | 6/1968 | Fellwock | |
| 3,403,473 A | * | 10/1968 | Navarro | E05D 15/502 49/193 |
| 3,430,386 A | * | 3/1969 | Schmitt | E05D 7/02 49/382 |
| 3,455,061 A | | 7/1969 | Kesling et al. | |
| 3,629,972 A | | 12/1971 | Rehberg et al. | |
| 3,675,271 A | | 7/1972 | Fellwock et al. | |
| 3,869,753 A | | 3/1975 | Boback | |
| 4,151,681 A | * | 5/1979 | Roberts | E05D 3/04 312/321.5 |
| 4,215,449 A | | 8/1980 | Loikitz | |
| 4,248,489 A | | 2/1981 | Barroero et al. | |

(Continued)

FOREIGN PATENT DOCUMENTS

CN 104033058 A 9/2014

OTHER PUBLICATIONS

"Reversing Frigidaire Top Freezer Refrigerator Door," retrieved from Internet URL: http://www.applianceaid.com/reversing-frigidaire-top-freeezer-refrigerator-door.php, on Jan. 15, 2019, pp. 8.

(Continued)

*Primary Examiner* — Justin B Rephann
(74) *Attorney, Agent, or Firm* — Middleton Reutlinger

(57) ABSTRACT

A reversible door assembly is provided which allows for easy changing of a door swing direction without the need for any additional swing change kit and without the need for rotation of the door. The present embodiments provide a frame which utilizes removable pocket hinge elements which may be moved from one side of the frame to the other side in order to easily change the door swing direction.

8 Claims, 14 Drawing Sheets

(56) References Cited

U.S. PATENT DOCUMENTS 4,539,819 A 9/1985 Alba et al.
4,864,691 A * 9/1989 Gidseg ..... E05D 3/04 16/312
4,932,729 A * 6/1990 Thompson ..... A47B 91/002 16/19
5,228,240 A 7/1993 Barroero et al.
5,232,277 A * 8/1993 Cassady ..... E05D 5/065 16/221
5,960,518 A * 10/1999 Jeong ..... E05D 7/123 16/257
6,209,265 B1 * 4/2001 Banicevic ..... F25D 23/02 49/382
6,868,692 B2 3/2005 Choi
7,043,886 B1 5/2006 Chubb
7,065,832 B2 * 6/2006 Pohl ..... F25D 23/028 16/221
8,277,005 B2 10/2012 Jung et al.
9,435,579 B1 * 9/2016 House ..... F25D 23/028
9,903,638 B2 * 2/2018 Dubina ..... E05D 7/02
2003/0151339 A1 * 8/2003 Reed ..... E05D 11/1078 312/405
2004/0182104 A1 * 9/2004 Choi ..... F25D 23/028 62/389
2006/0064846 A1 * 3/2006 Espindola ..... E05D 11/0081 16/223
2007/0163180 A1 * 7/2007 Steinberg ..... E05F 1/002 49/382
2007/0204647 A1 * 9/2007 Puthiyaveetil ..... F25D 23/126 62/389
2008/0048539 A1 2/2008 Beek et al.
2010/0101267 A1 * 4/2010 Jung ..... E05B 17/0033 62/449

OTHER PUBLICATIONS

"Reversing the Instructions Door Swing" retrieved from Internet URL: http://www.homedepot.com/catalog/pdfImages/0b/0b70c905-3df3-4445-ba23-52ee1417a589.pdf, on Jan. 15, 2019, pp. 4.
U.S. Appl. No. 62/589,967 entitled "Molded Frame for a Reversible Appliance Door" filed Nov. 22, 2017.

* cited by examiner

MOLDED FRAME FOR A REVERSIBLE APPLIANCE DOOR

CLAIM TO PRIORITY

This non-provisional patent application claims priority to and benefit of, under 35 U.S.C. § 119(e), U.S. Provisional Patent Application Ser. No. 62/589,967, filed Nov. 22, 2017 and titled "Molded Frame For A Reversible Appliance Door", all of which is incorporated by reference herein.

BACKGROUND

1. Field of the Invention

Present embodiments relate to an appliance. More specifically, but without limitation, present embodiments relate to an appliance door assembly having a one piece molded frame which utilizes removable inserts to easily reverse the door swing of the appliance.

2. Description of the Related Art

Often times during the manufacturing process or after an appliance is sold, appliance door swing is required to be changed in order to accommodate a specific installation for, for example, due to an order change or change in kitchen layout at an original equipment manufacturer. Further, when remodels occur in recreational vehicles, the appliance may be moved which can necessitate change in door swing.

Known refrigerator appliances often require a specific kit to change a door swing or rotation. This is a time consuming and costly method of changing the door swing either during the manufacturing process or by end user when, for example, a cabinet arrangement is altered or an appliance is moved requiring changing of the appliance door swing.

It would be desirable to reduce the need to buy any additional kit in order to change a door swing of an appliance. It would also be desirable to reduce manufacturing costs associated with the parts and labor associated with such door change. Further, it would be desirable to reduce complexity of performing such door swing change on a partially manufactured appliance or a fully manufactured appliance at time of installation.

The information included in this Background section of the specification, including any references cited herein and any description or discussion thereof, is included for technical reference purposes only and is not to be regarded subject matter by which the scope of the invention is to be bound.

SUMMARY

A reversible door assembly is provided which allows for easy changing of a door swing direction without the need for any additional swing change kit and without the need for rotation of the door.

The present embodiments provide a frame which utilizes removable pocket hinge elements which may be moved from one side of the frame to the other side in order to easily change the door swing direction.

According to some embodiments, a reversible door assembly for an appliance may comprise a door liner and gasket disposed on an inner side of the door liner, a door frame disposed on an outer side of the door liner, the door frame having a first vertical side, a second vertical side and an upper lateral member and a lower lateral member extending between the first and second sides, the door frame being a molded, one-piece structure, the frame having a first pair of pockets closer to the first side of the frame and formed in the frame, the frame having a second pair of pockets closer to the second side of the frame and formed in the frame, a first pair of pocket blanks and a second pair of pocket hinge elements, the first pair of pocket blanks disposed along one of the first and second pairs of pockets and the second pair of pocket hinge elements disposed in the other of the first and second pairs of pockets, the pocket hinge elements and the pocket blankets being reversible between the first pair of pockets and the second pair of pockets of the door frame to reverse a swing direction of the door assembly.

Optional embodiments may also be provided for use with the door assembly. For example, according to some embodiments, the pocket hinge element slides into one of the pockets in a first direction and a fastener connects in a second direction. The frame may have a retainer configured to retain a moisture barrier layer. The reversible door assembly may further comprise end caps with retainers. The retainer may have guide openings at the pocket. The blanks and the pocket hinge elements closing gaps in the retainers and retaining a portion of a moisture barrier. The hinge element may have an insert portion. The hinge element may further comprise a retainer portion. The reversible door assembly may further comprise a hinge portion extending outwardly from the insert portion. The reversible door assembly may further comprise a door handle assembly.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages of present embodiments is provided in the following written description, illustrated in the accompanying drawings, and defined in the appended claims.

BRIEF DESCRIPTION OF THE DRAWINGS

In order that the embodiments may be better understood, embodiments of a molded frame for a reversible appliance door will now be described by way of examples. These embodiments are not to limit the scope of the claims as other embodiments of a molded frame will become apparent to one having ordinary skill in the art upon reading the instant description. Non-limiting examples of the present embodiments are shown in figures wherein:

DETAILED DESCRIPTION

Figure 1:
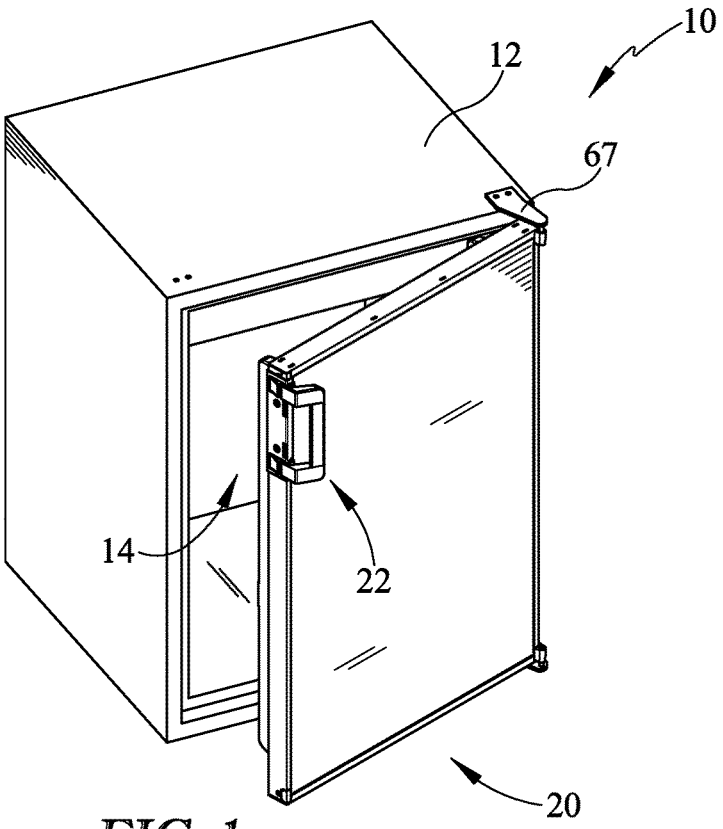
FIG. 1 is a front perspective view of an illustrative appliance with the door swing in a first direction.

It is to be understood that a molded frame for a reversible appliance door is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Referring now to FIGS. 1-15, the present embodiments of a reversible door assembly for an appliance are depicted. The present door assembly allows for easy transition from a first door swing to a second door swing without the need to purchase additional door swing kits and further reduce manufacturing costs and labor costs associated with such transition. Additionally, post manufacturing, the door swing may also be easily changed from a first swing direction to a second swing direction. The door assembly provides for varied direction of rotation in order to provide easy transition between first and second door swings without requiring additional kits or rotation of the door.

With reference now to FIG. 1, an appliance 10 is depicted in a perspective view. The appliance 10 may be of various types that have doors to open and close for access. The instant embodiment is described as relative to a refrigerator but this description should not be considered limiting as other appliances may be utilized such as dishwashers, ovens, microwave doors, freezers, or any other device which utilizes a hinged door to open and close.

The present embodiment provides an appliance 10 having a housing 12 with an interior cabinet 14 wherein fresh or frozen food may be stored in order to prevent spoilage, according to some embodiments. The cabinet 14 is open along one plane and a door assembly 20 is hingedly connected to the housing 12 in order to close access to the cabinet 14 or open access to the cabinet to access, such as to retrieve or replace food within the appliance 10.

In the instant embodiment, the door assembly 20 comprises a first swing direction. The swing direction may be right hand swing as depicted, or may be left hand swing direction. During the manufacturing or post-manufacturing, for example, during installation, it may become necessary to change the swing direction of the door. When this occurs, the door swing may be changed from the direction shown in FIG. 1 to the direction shown in FIG. 2.

Figure 2:
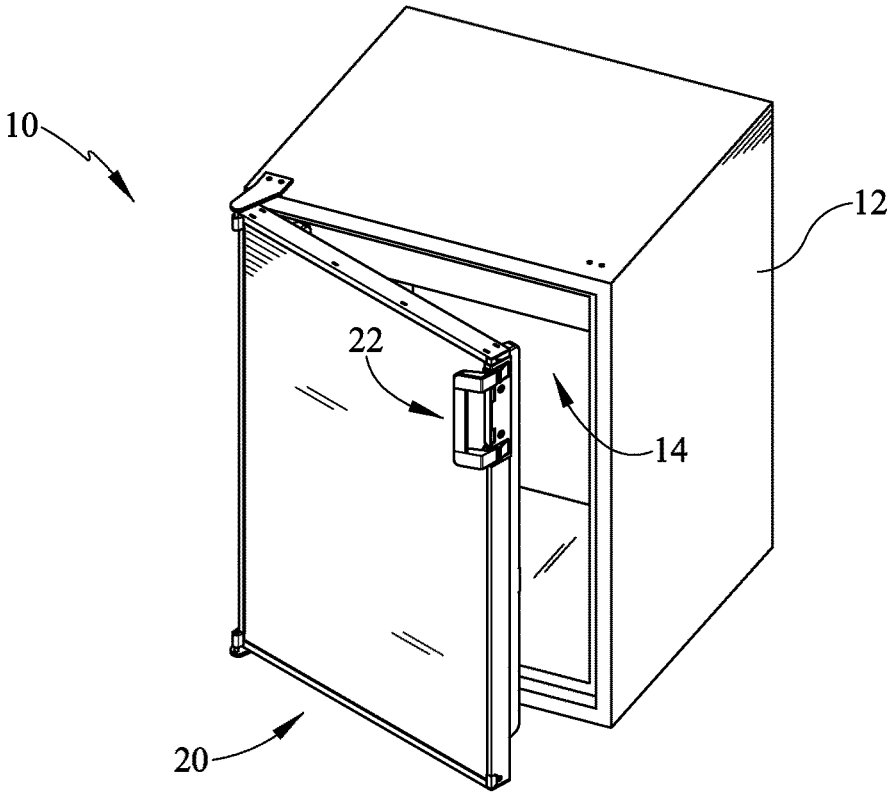
FIG. 2 is a front perspective view of the illustrative appliance with the door swing converted to a second direction.

With reference additionally to FIG. 2, the appliance 10 is depicted with a door assembly 20 having a second swing direction, for example left hand swing. The illustrative embodiment shows a right and a left hand swing direction. However, other embodiments may utilize an up and down swing direction or other directions depending on orientations of the door and the type of appliance being utilized.

Figure 3:
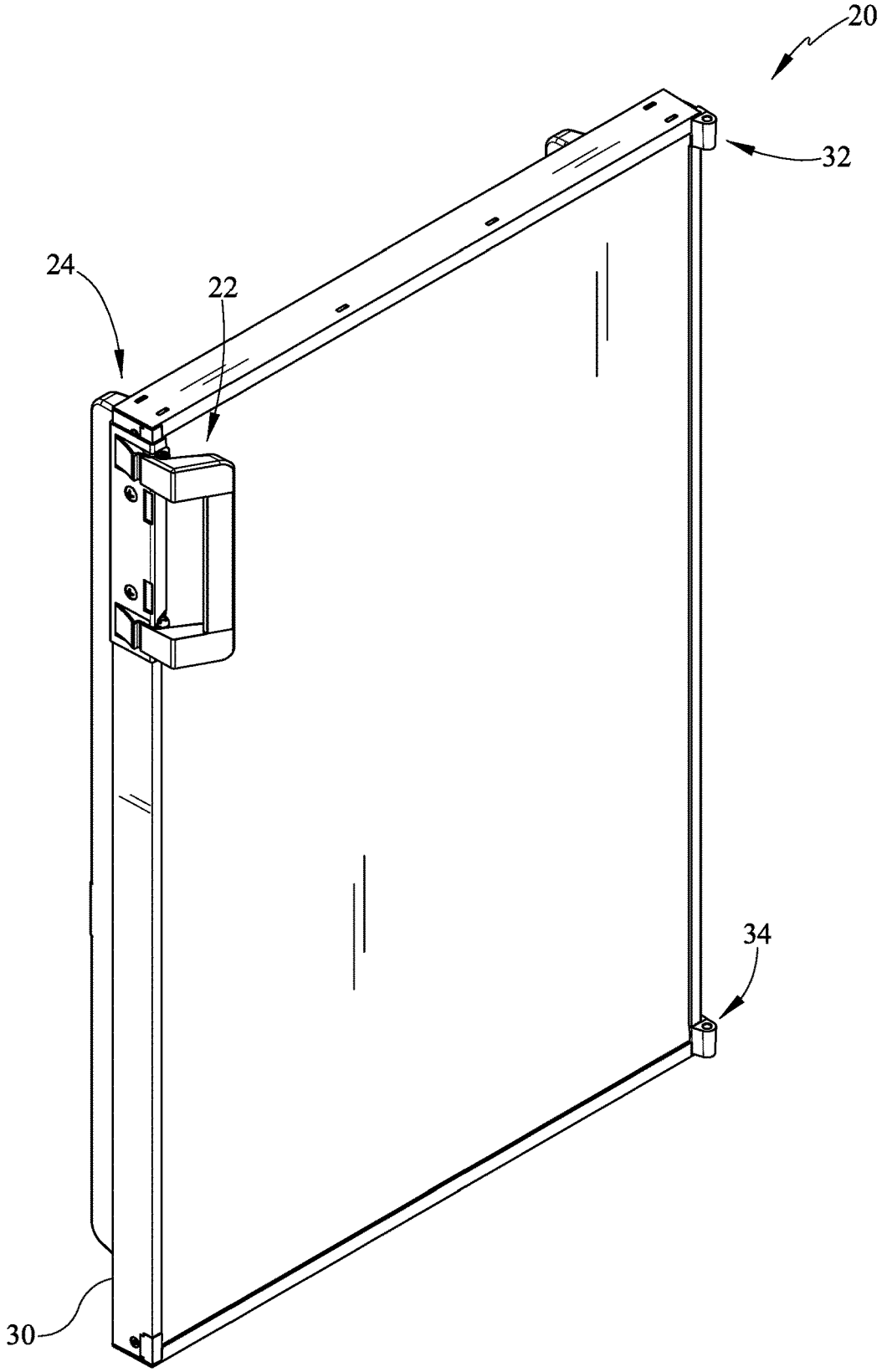
FIG. 3 is a front perspective view of an appliance door assembly.

Referring now to FIG. 3, an assembled perspective view of an illustrative appliance door assembly 20 is depicted with the swing direction depicted in FIG. 1. For purpose of reference, the term "inside" references the side of the door toward the inside of the appliance 10, and the term "outside" refers to the opposite or exterior side of the door assembly 20. In the instant embodiment, the door assembly 20 is shown from the outside and comprises a right hand swing. Accordingly in this view, the door assembly 20 comprises a door handle assembly 22 on the left hand side of the door assembly 20 to provide for opening or closing thereof. Along the rear of the door 20, which is toward the inside of the door 20, is a door liner 24. The door liner 24 may be molded plastic or other material which may or may not be insulative. A door frame 30 extends about the outside or front side of the door liner 24. Shown at the right hand of the door assembly 20, and providing the right hand swing, are first and second pocket hinge elements 32, 34. The pocket hinge elements 32, 34 are shown aligned vertically on the right hand side of the door assembly 20. However, the pocket hinge elements 32, 34 may be removed from one side and placed on the alternate side of the door assembly 20 in order to convert the door assembly 20 to a left hand swing.

The door handle assembly 22 may include a handle which pivots to disengage catches on the housing 12. Various types of handles and closures may be utilized and the depicted embodiment is merely illustrative but not limiting.

Figure 4:
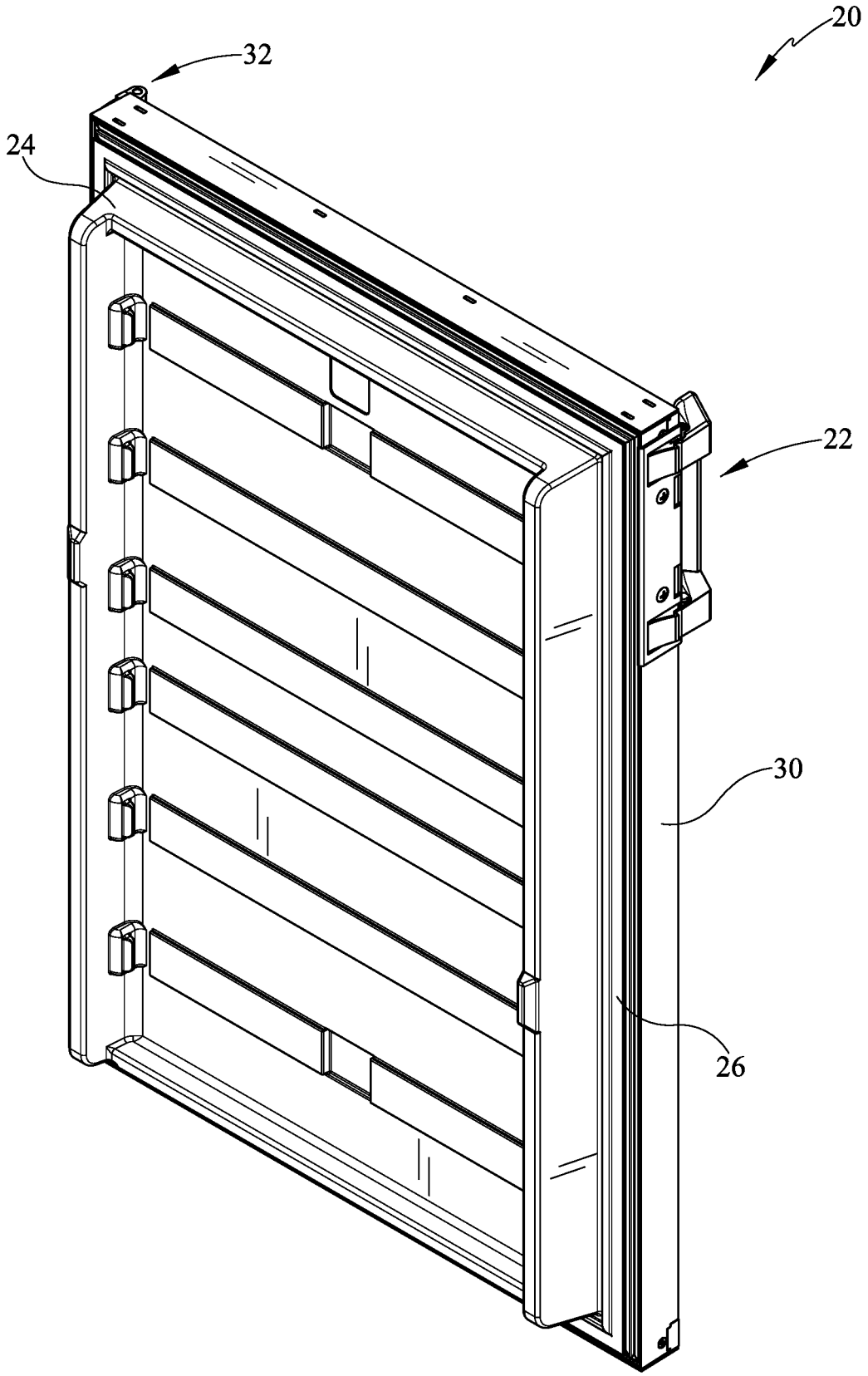
FIG. 4 is rear perspective view of the door assembly of FIG. 3.

Referring now to FIG. 4, the door assembly 20 is shown again in rear perspective. Again, the rear side of the door assembly 20 is referenced as, or corresponds to the interior side of the door assembly 20. In this view, the interior of the door liner 24 and a gasket 26 is positioned on the door liner 24 adjacent to the door frame 30. The gasket 26 may be rubber or other malleable material that allows for a sealing closure against the cabinet housing 12 of the appliance 10. The gasket 26 may also be magnetized in some embodiments in order to aid in closing or retaining the door assembly 20 in a closed position.

The interior of the liner 24 may include molded features such as shelving attachments or other features. This may allow for storage in the door assembly 20 of various food products.

Figure 5:
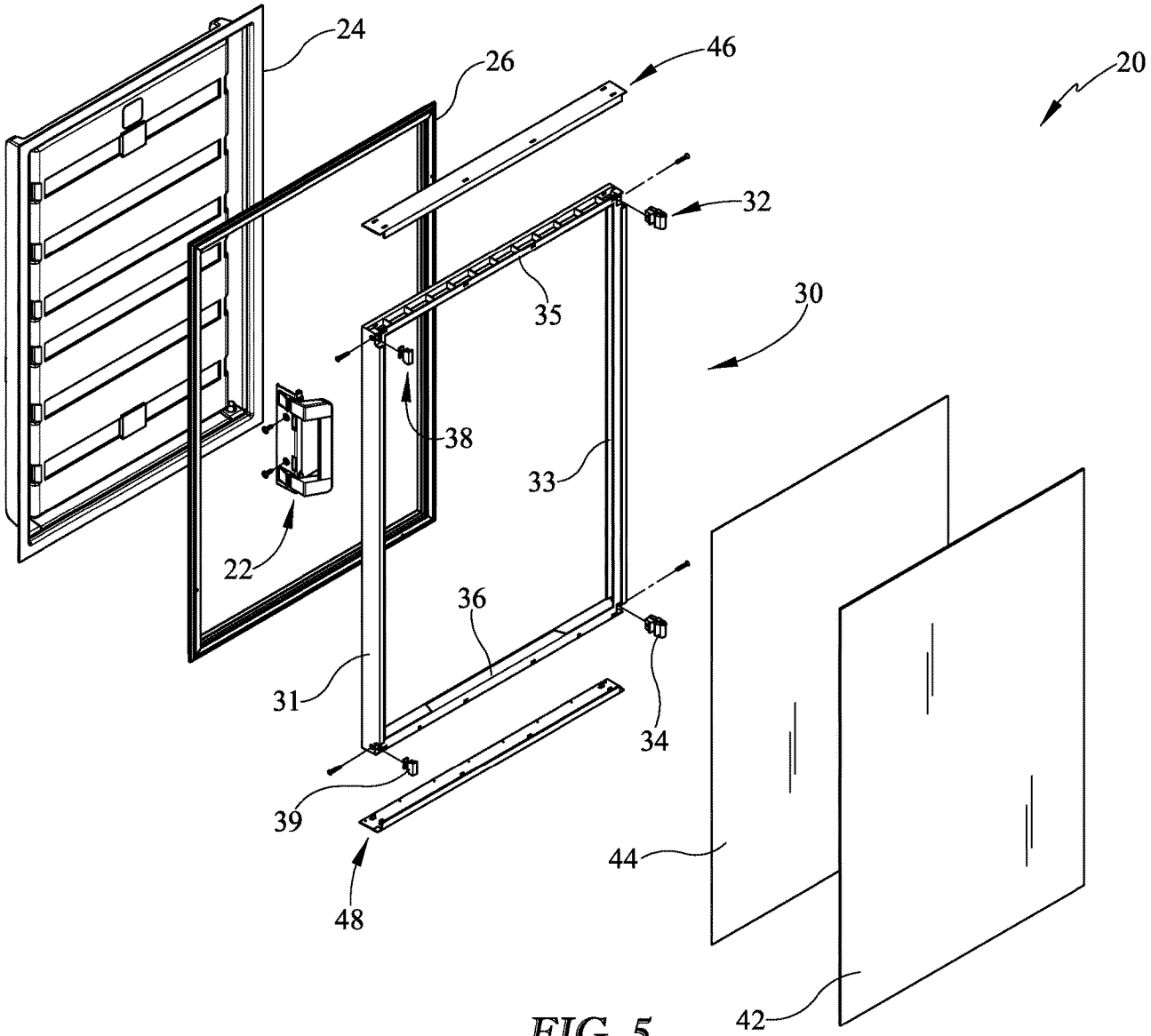
FIG. 5 is an exploded perspective view of the door assembly of FIGS. 3 and 4.

With reference now to FIG. 5, an exploded perspective view of the door assembly 20 is depicted. Starting at the right hand side of the view, an exterior panel 42 is depicted. The exterior panel 42 may be of any various types of materials, including but not limited to, stainless steel, acrylic, wood or any other desirable finishing surface for the exterior of the appliance 10. Moving rearward, a moisture barrier 44 is shown next. The moisture barrier 44 may be formed with various materials which inhibit moisture transfer and a base material such as cardboard, wood, metal, or any other material upon which a moisture barrier layer is positioned.

Moving further rearward, is the door frame 30. The door frame 30 is a one-piece molded structure comprising first and second vertical sides 31, 33 and upper and lower lateral members 35, 36 extending between the first and second vertical sides 31, 33. The door frame 30 is a one-piece molded structure so that no assembly of the separate elements is required. Additionally, shown adjacent to the frame 30 is a pocket hinge element 32. At the opposite side of the door frame 30 relative to a vertical center line, is a pocket blank 38. Although the frame 30 is shown as rectangular, other shapes may be utilized depending on the door shape.

Above and below the door frame 30 are door caps 46, 48, which may be utilized to hide fasteners or other parts relative to the door frame 30. Behind the door frame 30 is the door gasket 26 which is positioned for use on the rear side of the door liner 24, as shown in FIG. 4.

Figure 6:
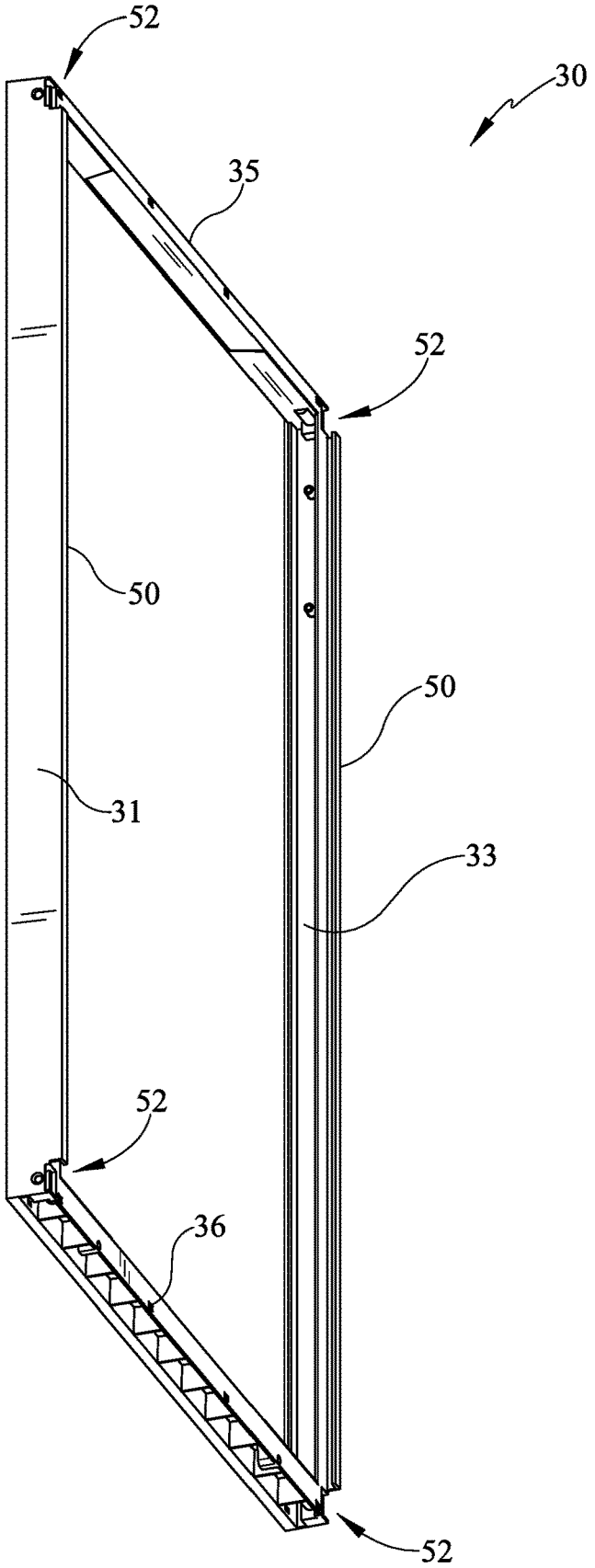
FIG. 6 is a front perspective view of a door frame.

Referring now to FIG. 6, a front perspective view of the door frame 30 is depicted. The door frame 30 includes the first and second vertical sides 31, 33 and the upper and lower lateral members 35, 36, which are molded integrally to form a substantially rectangular shape. The shape may vary depending upon the shape and size of the overall door shape.

At the upper ends of the first and second vertical sides 31, 33 are guides 52. The guides 52 may be partially formed by gaps in a retainer 50 which extends around the perimeter of the frame 30. The retainer 50 may be considered to be formed of four portions, one corresponding to each of the sides 31, 33 and members 35, 36. The retainers 50 associated with the lateral members 35, 36 are formed on caps 46, 48 but may also be formed on the members 35, 36. The retainer 50 also functions to retain the moisture barrier 44 (FIG. 5) in position and optionally, the exterior panel 42 (FIG. 5). The guides 52 formed in the retainer 50 provide entry points and guidance to pockets 60 (FIG. 8) at each corner of the frame 30. Near the guides 52 and toward the rear of the frame 30, pockets 60 are formed in the frame 30 to receive the pocket hinge elements 32, 34 and the pocket blanks 38, 39 (FIG. 5).

Figure 7:
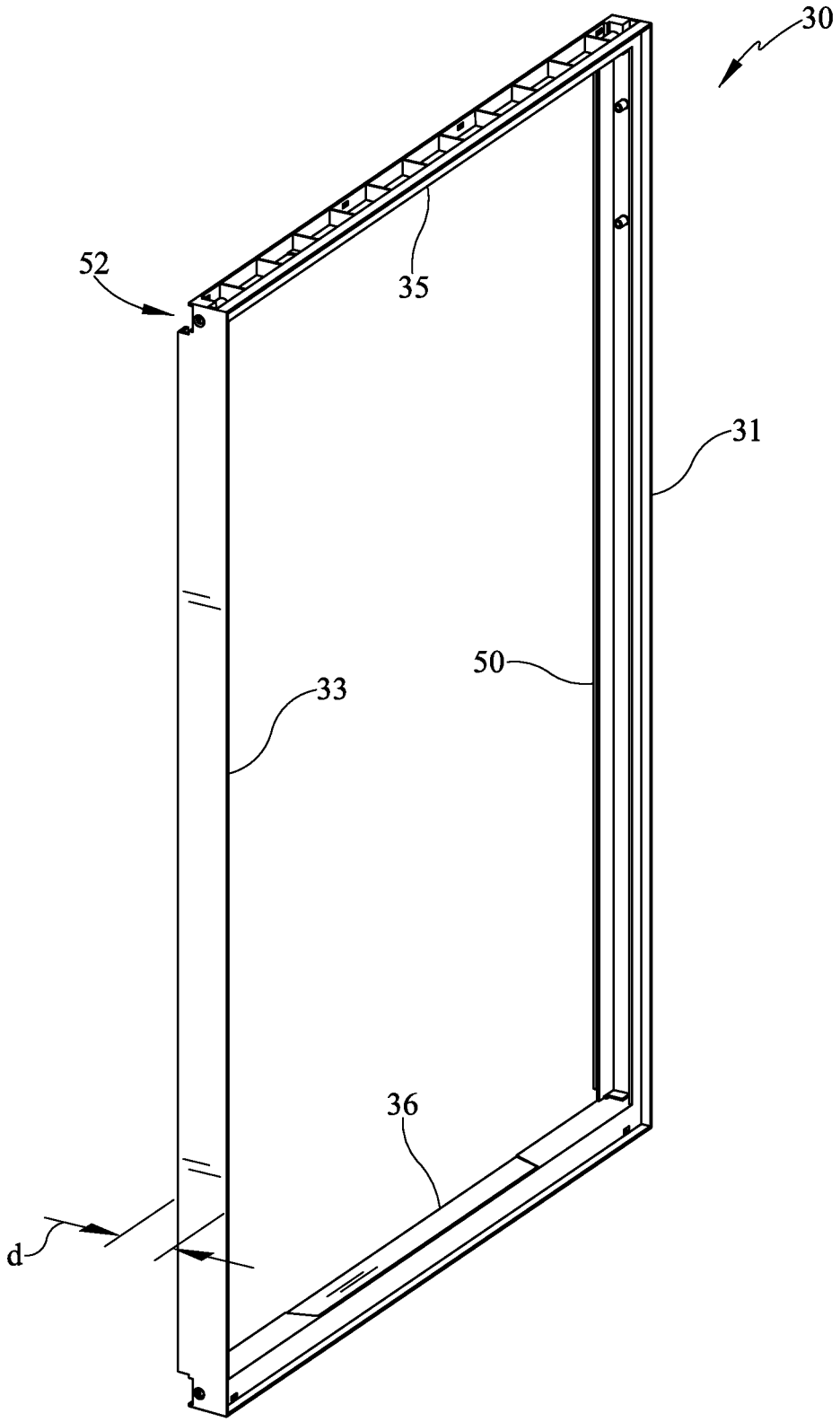
FIG. 7 is a rear perspective view of the door frame of FIG. 6.

With reference to FIG. 7, the frame 30 is shown in rear perspective view with the rearward edge of the frame 30 depicted. The frame 30 is shown rotated about a vertical axis from its position and shown in FIG. 6. The frame 30 has a depth "d" which may correspond to a depth of a foam insulation which may be injected into the interior area of the frame 30 once the frame 30 is positioned on the door liner 24 (FIG. 5). Additionally, the depth of the frame 30 may be relevant to the depth of the end caps 46, 48.

Figure 8:
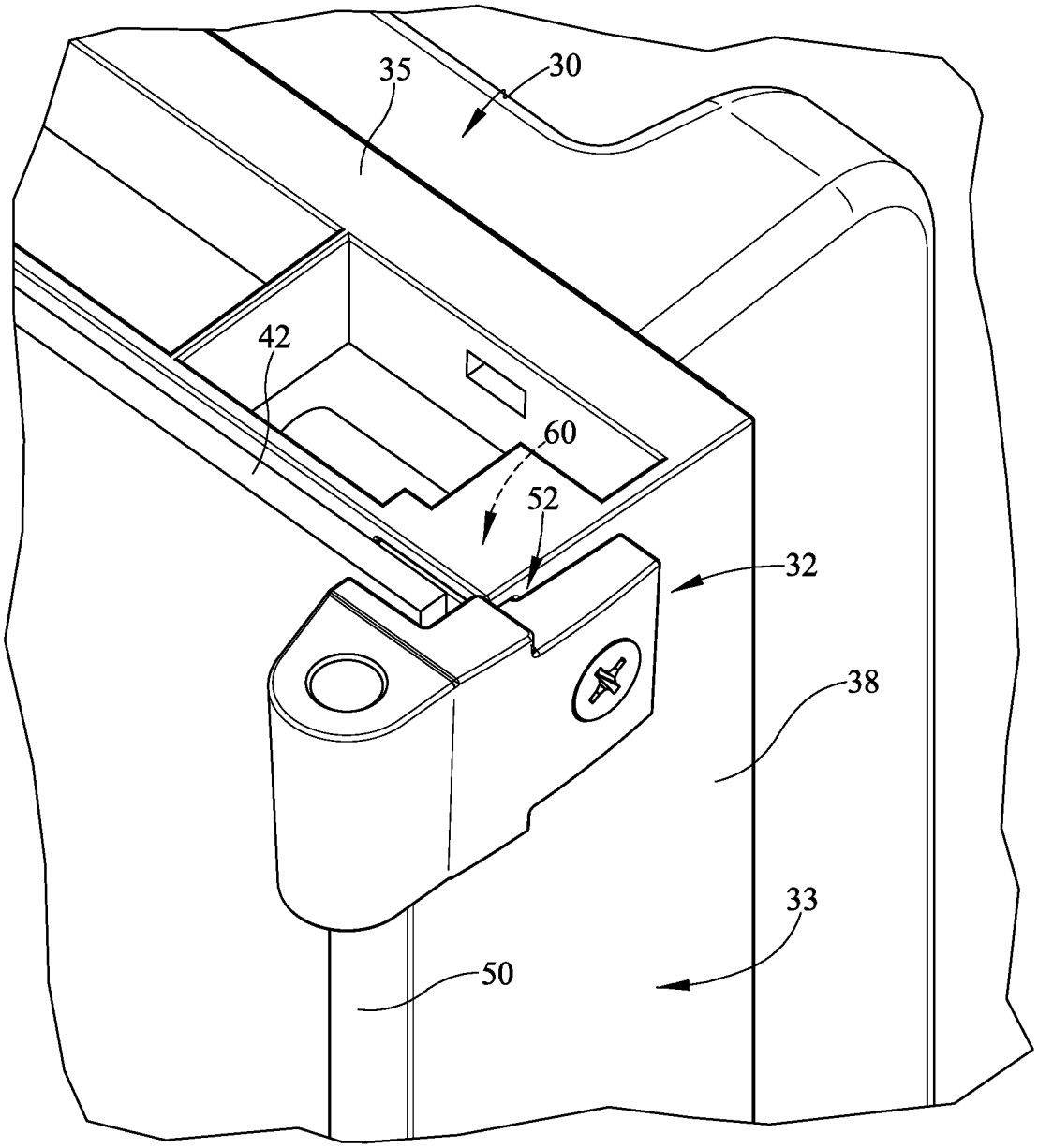
FIG. 8 is an assembled view of a pocket hinge element.

Referring now to FIG. 8, a pocket hinge element is shown in an assembled configuration on and in the frame 30. The corner depicted is one where the upper lateral member 35 engages an upper end of the vertical side 33. Along the front edge of the vertical side 33, the retainer 50 is shown. With brief reference again to FIG. 6, the upper guide 52 is provided where the retainer 50 ends near the corner of the vertical side 33. The retainer 50 retains the exterior panel 42 (FIG. 5) in position up to the guide 52 where the pocket hinge element 32 then retains the corner of the panel 42.

The pocket 60 is located beneath a surface of the lateral member 35 near the vertical side 33. These pockets 60 may be located at various locations but provide for positioning of the pocket hinge elements 32, 34, pocket blanks 38, 39.

Figure 9:
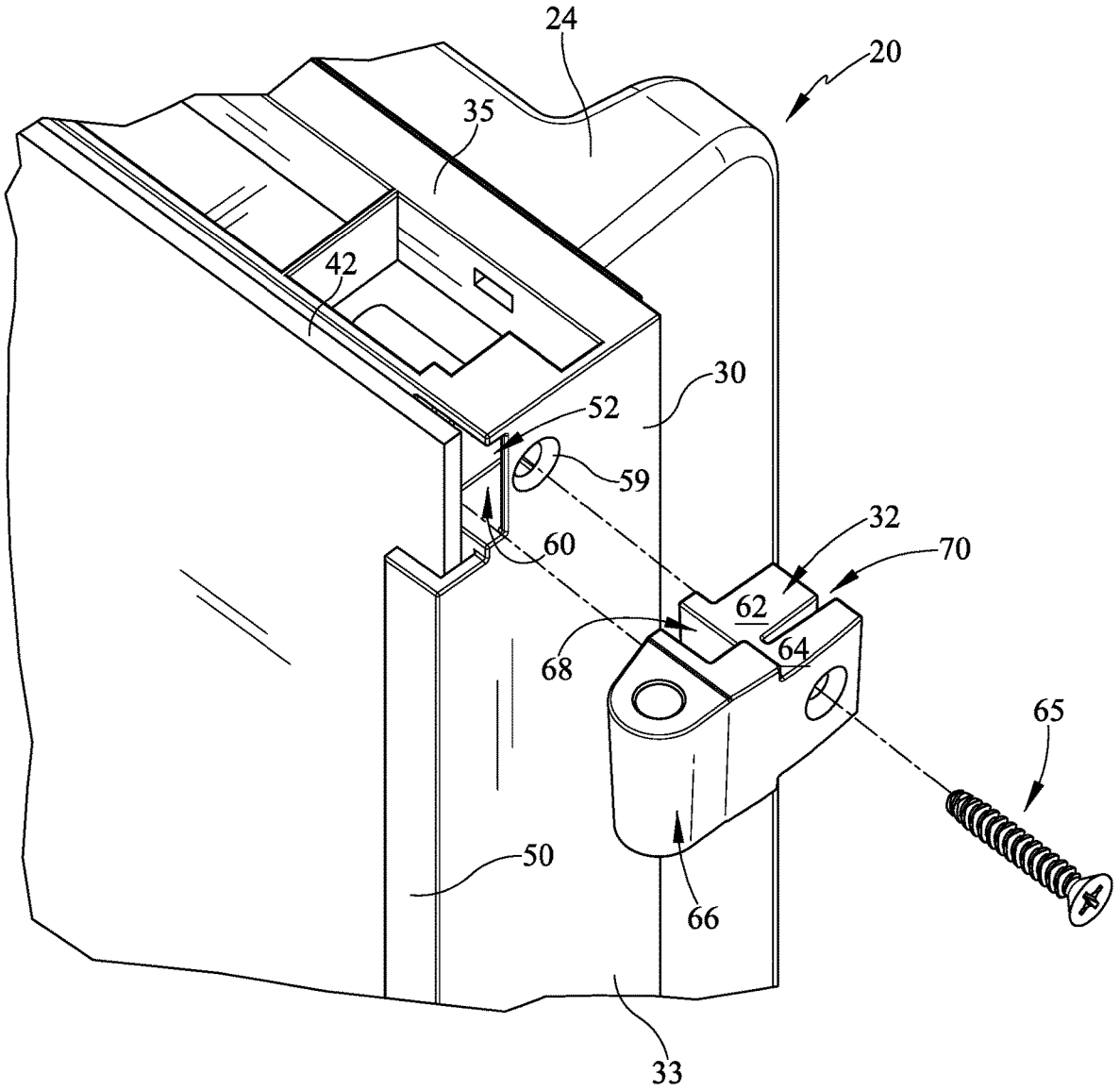
FIG. 9 is an exploded perspective view of the pocket hinge element.

With reference now to FIG. 9, the pocket hinge element 32 is exploded from the frame 30 and its assembled portion of FIG. 8. In this view, the retainer 50 is also shown as an L-shaped structure which retains the exterior panels 42 in position relative to the frame 30. Further, the pocket hinge element 32 also engages the exterior panel 42. The pocket 60 may also be seen in this view with the pocket hinge element 32 removed. The pocket 60 is formed in the frame 30 and receives a portion of the pocket hinge element 32 or alternatively, may receive the pocket blank 38.

The pocket hinge element 32 includes a pocket insert 62 and a brace 64. The pocket insert 62 is positioned within pocket 60 and brace 64 is positioned on the exterior of the frame 30 bracing the pocket hinge element 32 relative to the frame 30. A fastener 65 may be utilized to connect and retain the pocket hinge element 32 in position on the frame 30. Extending from the brace 64 is a hinge element 66. The hinge element 66 may be in the form of a male or female part which engages the other of a male or female part which is connected to the housing or cabinet of the appliance 10. The hinge element 66, according to the illustrative and non-limiting embodiment, may be a collar which is generally a hollow, cylindrical shape that receives a pin from the housing hinge element 67 (FIG. 1) and provides the pivoting motion of the door assembly 20 relative to the housing 12 (FIG. 1) of the appliance 10 (FIG. 1). Between the hinge element 66 and the insert 62 and/or brace 64 is a clearance 68 which allows receipt of an edge of the exterior panel 42 therein. Similarly, a frame clearance 70 is located between the insert 62 and the brace 64. This clearance 70 allows for positioning of a wall of the frame 30 therebetween.

Although not aligned in this figure, the insert 62 is positioned into the pocket 60 and the brace 64 is therefore on the outer surface of the vertical side 33, as shown in FIG. 8.

Figure 10:
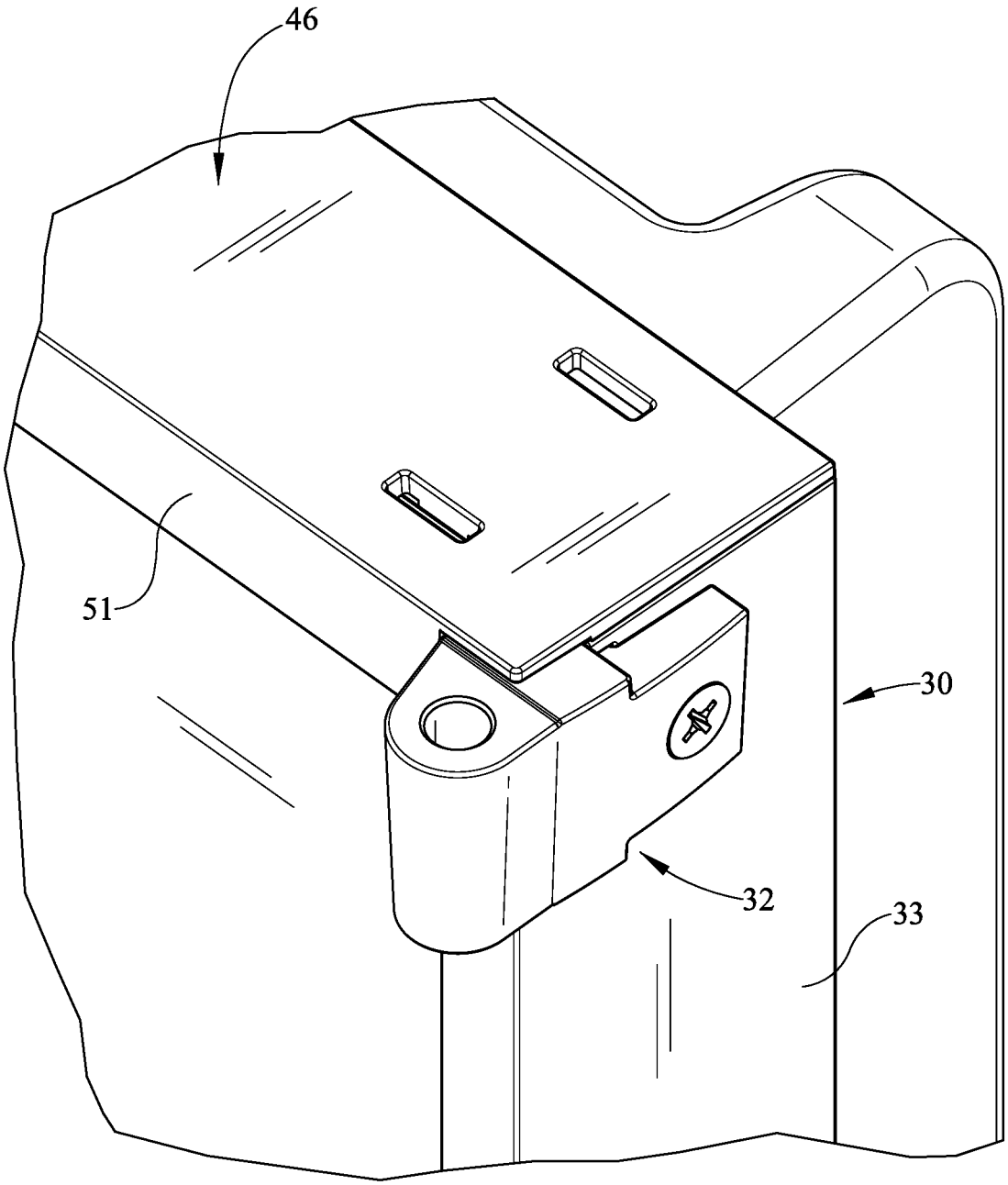
FIG. 10 is an assembled view of the pocket hinge element including an end cap for the frame.

Referring now to FIG. 10, an additional perspective view is shown. The upper edge of the frame 30 is covered with the end cap 46. The end cap 46 hides any of the structural features of the upper lateral member 35. Likewise a lower end cap 48 (FIG. 5) may be utilized on the lower lateral member 36 to cover any of those structural features. The caps 46, 48 may be snap-fit, fastened or otherwise attached to the frame 30. The caps 46, 48 may include retainers 51 to retain the exterior panel 42 and/or moisture barrier 44, along the upper and lower edges.

In addition to the FIGS. 8 and 9, it is clear that the pocket hinge element 32 is positioned into the pocket 60 in a first direction. That is, the insert is positioned from a front toward a rear movement in order to position to be located within the pocket 60 and align a fastener 65 with holes through the brace 64, insert 62 and through a fastening aperture 59 in the vertical side 33. Additionally, the pocket hinge element 32 is fastened in a second direction. The second direction may be at some angle to the direction of insertion into the pocket 60 such as a perpendicular direction as depicted in the embodiment. For example, as shown the fastener may extend horizontally as shown which is perpendicular to the insertion direction. In other embodiments, the fastener may be inserted from the top down, which is also at an angle to the insertion direction. Still further, the pocket hinge element 32 extends in a direction that is perpendicular to the insertion direction and that of the fastening direction in order to provide the ability to hinge.

Figure 11:
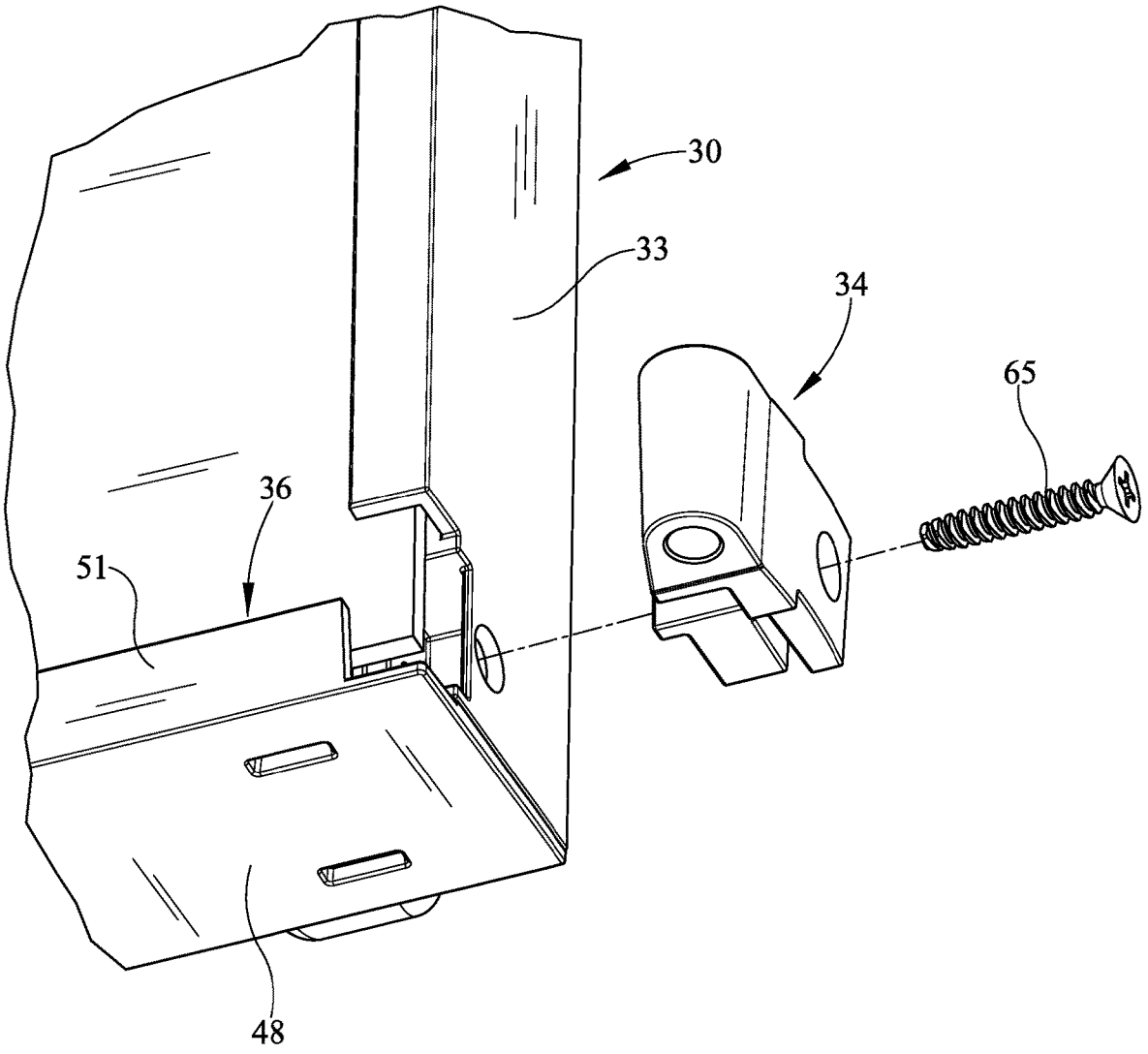
FIG. 11 is an exploded perspective view of a pocket hinge element at the opposite end of the frame.
Figure 12:
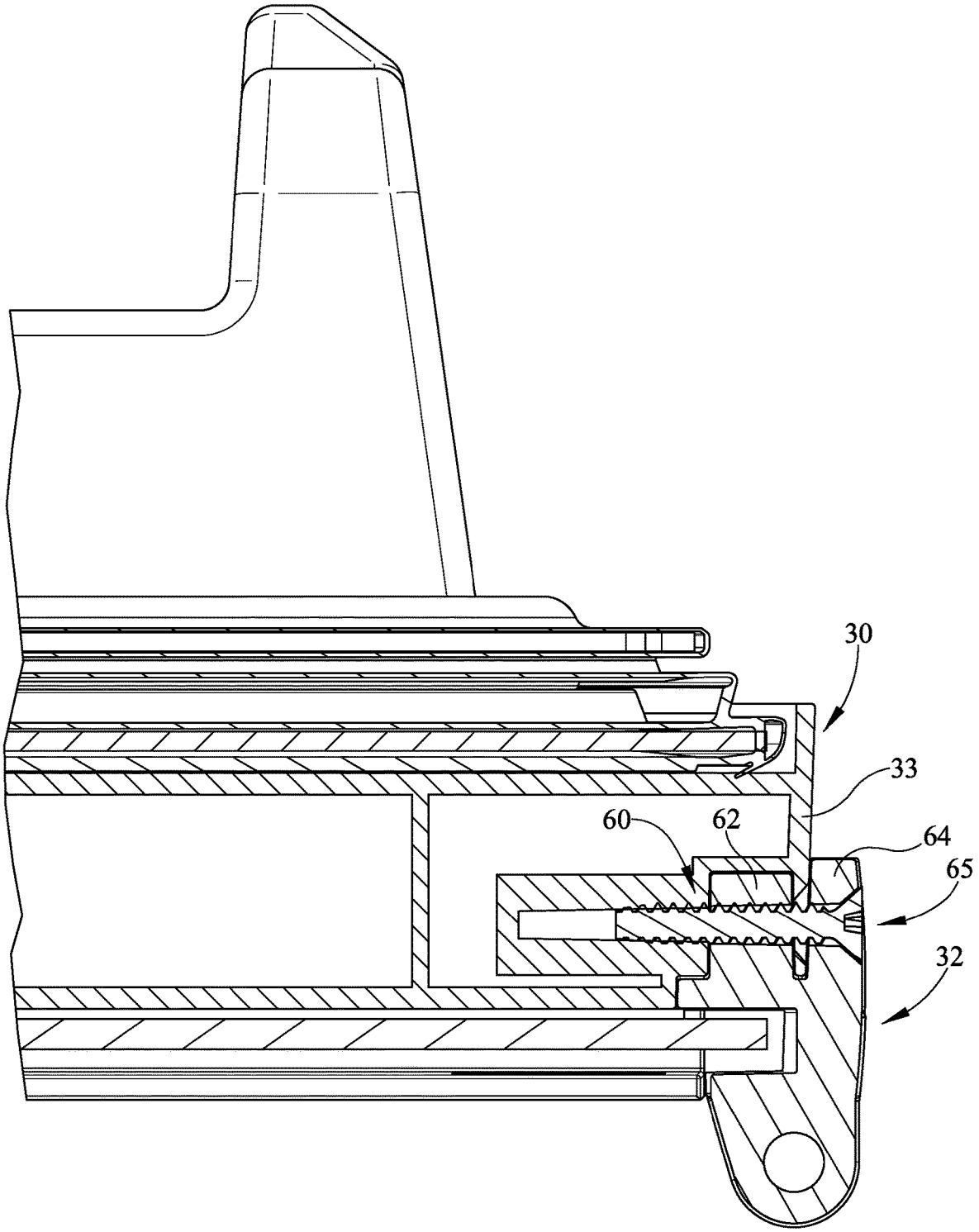
FIG. 12 is a section view of one of the pocket hinge elements in an assembled configuration relative to the door frame.

With reference to FIG. 11 a lower end of the vertical side 33 is depicted as exemplary and the pocket hinge element 34 is shown exploded from the frame 30. The lower end cap 48 is positioned on the lower lateral member 36. Still further, with reference to FIG. 12, a section view of the frame 30 is depicted at a pocket hinge element 34. With the pocket 60 revealed, the insert 62 is positioned therein and the brace 64 is located along an outer surface of the vertical side 33. In combination, the previous views depict that the door frame 30 may be utilized to position the pocket hinge element 32, 34 along the right hand edge to provide the right hand swing of FIG. 1. However, the views also depict that by disconnecting a fastener 65, these pocket hinge elements 34 may be easily removed from the frame 30 and moved to the opposite lateral corners in order to provide the opposite swing direction for the door assembly 20. This configuration change does not require rotation of the door assembly 20 or does not require any alternative hinge kits which are difficult to install.

Further, in order to change door swing, one only needs to move the hinge element from the pockets 60 of one side of the opposite frame side. The door assembly 20 may be mounted and the handle assembly 22 would move to accommodate the swing change.

Figure 13:
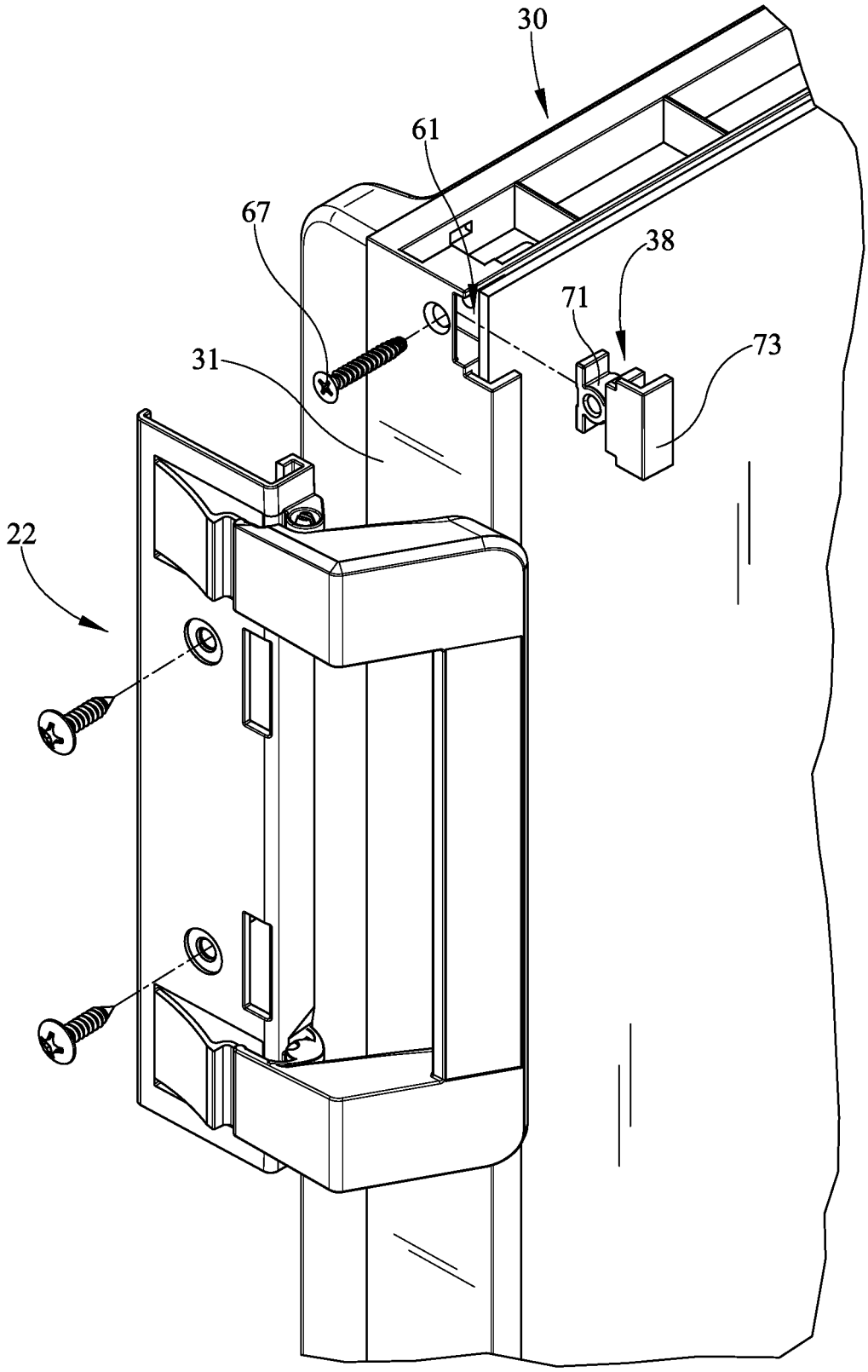
FIG. 13 is an exploded perspective view of a pocket blank at an opposite side of the door frame.

With reference now to FIG. 13, an opposite side of the frame 30 is depicted. The handle assembly 22 is shown exploded from the frame 30. Additionally, a pocket blank 38 is shown exploded from the frame 30. The upper corner of the frame 30 is a pocket 61. A fastener 67 is shown partially inserted into a fastening aperture in the vertical side 31. The pocket blank 38 is removed from the pocket 61 to reveal a fastener retainer 71 which aligns with the fastener 67 extending through the frame 30. The pocket blank 38 further comprises a retainer 73 fills the gap at the upper corner and the lower corner of the frame 30 along the vertical side 31 to also retain the exterior panel 42 in position. This is similar to one function of the pocket hinge element 32, 34.

Figure 14:
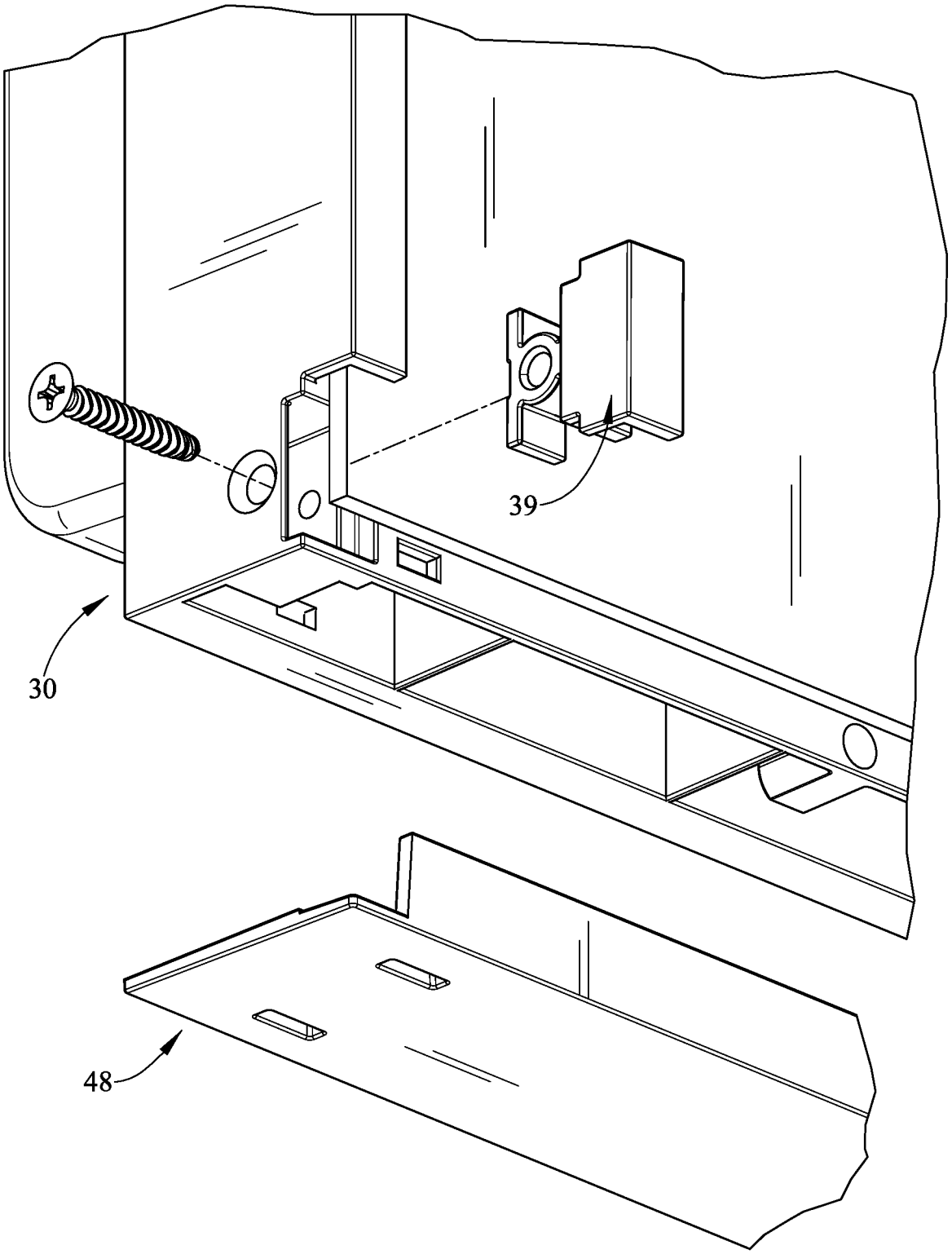
FIG. 14 is another exploded perspective view of a pocket blank at a lower corner opposite the pocket blank of FIG. 13; and, FIG. 15 is an assembled perspective view of the pocket blank of FIG. 14.

With brief reference to FIG. 14, a lower pocket blank 39 is shown with the lower end cap 48 exploded from the frame 30. The pocket blank 39 is exploded from the pocket within the frame 30 and similar to the embodiment of the pocket hinge element 32, 34, the pocket blanks 38, 39 are inserted in a first direction and may be fastened in a second direction. These pocket blanks 38, 39 merely fill the pockets of the frame 30 but may be removed to reposition the pocket hinge elements 32, 34 in order to change the swing direction of the door.

Figure 15:
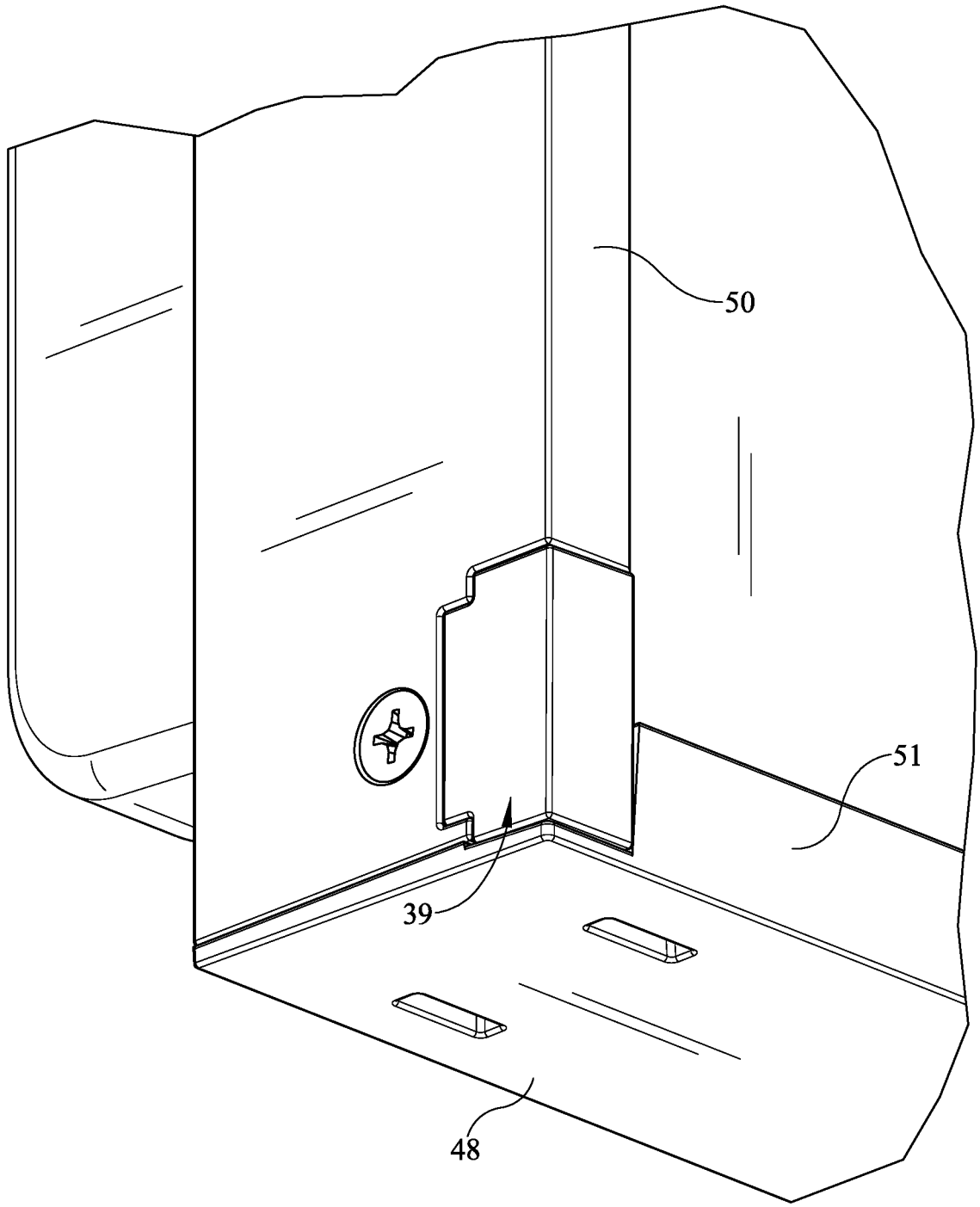

With reference to FIG. 15, the pocket blank 39 and the end cap 48 are shown in an assembled manner. The retainers 50, 51 and pocket blank 39 work to retain the portions of the door assembly 20.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A reversible door assembly for an appliance, comprising:

a door liner and gasket disposed on an inner side of said door liner;

a door frame disposed on an outer side of said door liner, said door frame having a first vertical side, a second vertical side and an upper lateral member and a lower lateral member extending between the first and second vertical sides, said door frame being a molded, one-piece structure;

said door frame having a first pair of pockets disposed adjacent to said first vertical side of said door frame and formed in said door frame;

said door frame having a second pair of pockets disposed adjacent to said second vertical side of said door frame and formed in said door frame;

a pair of pocket blanks and a pair of pocket hinge elements, said pair of pocket blanks disposed along one of said first or second pairs of pockets and said pair of pocket hinge elements disposed in the other of said first or second pairs of pockets;

said pair of pocket hinge elements and said pair of pocket blanks being reversible between said first pair of pockets and said second pair of pockets of said door frame to reverse a swing direction of said reversible door assembly; and, said pair of pocket hinge elements each further comprising an insert portion that is positioned within the other of said first or second pairs of pockets, a brace spaced from the insert portion to receive the door frame therebetween, and a hinge portion that is either male or female and defines a pivot location that is spaced from the door frame.

2. The reversible door assembly of claim 1 further wherein said pair of pocket hinge elements respectively slide into said pockets in a first direction and a fastener extends in a second direction differing from said first direction, to connect said pair of pocket hinge elements to said door frame.

3. The reversible door assembly of claim 1, said door frame having a retainer configured to retain a moisture barrier layer.

4. The reversible door assembly of claim 3 further comprising end caps each with an additional retainer.

5. The reversible door assembly of claim 4, said retainer of said door frame and said additional retainer of said end caps having guide openings at each of said pockets.

6. The reversible door assembly of claim 5, said pair of pocket blanks and said pair of said pocket hinge elements closing gaps in said retainers and retaining a portion of a moisture barrier.

7. The reversible door assembly of claim 1, further comprising a door handle assembly.

8. The reversible door assembly of claim 1, further comprising a clearance between said insert portion and said hinge portion, said clearance receiving a moisture barrier.

* * * * *